US005771864A

United States Patent [19]

Morishita et al.

[11] Patent Number: 5,771,864

[45] Date of Patent: Jun. 30, 1998

[54] FUEL INJECTOR SYSTEM

[75] Inventors: Akira Morishita; Shuzo Isozumi; Keiichi Konishi, all of Tokyo, Japan

[73] Assignee: Mitsubishi Denki Kabushiki Kaisha, Tokyo, Japan

[21] Appl. No.: 813,901

[22] Filed: Mar. 7, 1997

[30] Foreign Application Priority Data

Apr. 17, 1996 [JP] Japan ..... 8-095554

[51] Int. Cl.[6] ..... F02M 41/00

[52] U.S. Cl. ..... 123/456; 123/506

[58] Field of Search ..... 123/506, 456, 123/446–7, 500, 501

[56] References Cited

U.S. PATENT DOCUMENTS 4,777,921 10/1988 Miyaki et al. ..... 123/456
5,058,553 10/1991 Kondo et al. ..... 123/501
5,094,216 3/1992 Miyaki et al. ..... 123/506
5,197,438 3/1993 Yamamoto ..... 123/506
5,201,294 4/1993 Osuka ..... 123/456
5,313,924 5/1994 Regueiro ..... 123/456
5,526,790 6/1996 Augustin et al. ..... 123/456
5,577,892 11/1996 Shittler et al. ..... 123/506

*Primary Examiner*—Thomas N. Moulis
*Attorney, Agent, or Firm*—Sughrue, Mion, Zinn, Macpeak & Seas, PLLC

[57] ABSTRACT

A fuel injector system permits easier control of opening and closing a spill control solenoid valve of a high pressure supply pump. An electronic control unit holds the spill control solenoid valve fully closed or opened for the entire period of each stroke, during which delivery of fuel is possible, of a pump chamber. It adjusts the number of delivery cycles according to engine load, thereby controlling the pressure of fuel in the common rail to a desired pressure level.

17 Claims, 14 Drawing Sheets

FIG. 6(A) IDENTIFICATION OF CYLINDER

FIG. 6(B) CAM ANGLE

FIG. 6(C) CAM LIFT

FIG. 6(D) SOLENOID VALVE CONTROL SIGNAL

FIG. 6(E) CAM LIFT

FIG. 6(F) SOLENOID VALVE CONTROL SIGNAL

FIG. 8 (A) IDENTIFICATION OF CYLINDER

FIG. 8 (B) CAM ANGLE

FIG. 8 (C) CAM LIFT

FIG. 8 (D) SOLENOID VALVE CONTROL SIGNAL

FIG. 8 (E) CAM LIFT

FIG. 8 (F) SOLENOID VALVE CONTROL SIGNAL

FIG. 10(A) IDENTIFICATION OF CYLINDER

FIG. 10(B) CAM ANGLE

FIG. 10(C) CAM LIFT

FIG. 10(D) SOLENOID VALVE CONTROL SIGNAL

FIG. 10(E) CAM LIFT

FIG. 10(F) SOLENOID VALVE CONTROL SIGNAL

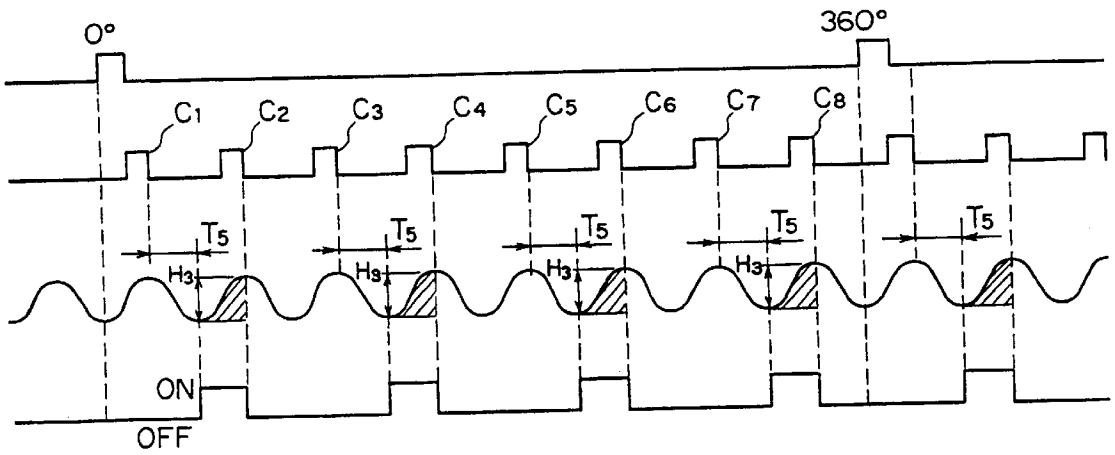
FIG. 14(A) IDENTIFICATION OF CYLINDER
FIG. 14(B) CAM ANGLE
FIG. 14(C) CAM LIFT
FIG. 14(D) SOLENOID VALVE CONTROL SIGNAL

FUEL INJECTOR SYSTEM

BACKGROUND OF THE INVENTION

1. Field of the Invention

The present invention relates to a fuel injection system and, more particularly, to a high pressure fuel injector system which has a common rail and used in, for example, a diesel engine, etc.

2. Description of Related Art

A fuel injector system which is disclosed in U.S. Pat. No. 4,777,921 or U.S. Pat. No. 5,094,216 is known as a common-rail type fuel injector system.

The fuel injector system disclosed in U.S. Pat. No. 4,777,921 employs, as a high pressure pump, a variable-discharge pump which permits the delivery stroke to be controlled by a spill solenoid valve. In the middle of the period of a delivery stroke during which the fuel in a pump chamber of the pump can be delivered, the spill solenoid valve is closed to deliver the fuel from the pump chamber to a common rail and the spill solenoid valve is kept closed for a predetermined time, then the spill solenoid valve is opened in the middle of the deliver stroke to make the fuel flow into a low pressure fuel path, thereby controlling the fuel pressure in the common rail to a predetermined pressure level.

The fuel injector system proposed in U.S. Pat. No. 5,094,216 employs, as a high pressure pump, a variable-discharge pump which permits the delivery stroke to be controlled by an outward opening type spill solenoid valve. In the middle of a stroke during which the delivery is possible in the pump, the spill solenoid valve is closed to deliver the fuel from the pump chamber into the common rail and the spill solenoid valve is kept closed until the end of the delivery stroke of the pump, and the energizing timing for opening the solenoid valve is controlled so as to control the fuel pressure in the common rail to a predetermined pressure level.

In the conventional fuel injector systems, the closed period and opened period of the spill solenoid valve for controlling the delivery stroke of the pump in the period of the stroke during which the delivery is possible in the pump are controlled in accordance with the common rail pressure, the engine speed or the engine load. Therefore, the conventional fuel injector systems have posed a problem in that the energizing timing for opening or closing the spill solenoid valve must be exactly controlled, thereby making to the control of the spill solenoid valve extremely difficult.

SUMMARY OF THE INVENTION

The present invention has been made with a view toward solving the problems discussed above and it is an object of the present invention to provide a fuel injector system which is capable of easily controlling the energizing timing for opening or closing the spill solenoid valve.

In order to achieve the above object, according to one aspect of the present invention, there is provided a fuel injector system which is equipped with: a common rail for accumulating pressurized fuel; an injection nozzle for injecting the pressurized fuel in the common rail into an engine cylinder; a high pressure supply pump having a pump chamber into which the fuel flows, the high pressure supply pump delivering the fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber to the common rail; and control means for controlling the opening and closing of the spill solenoid valve to keep the spill solenoid valve closed or opened for the entire period of time of each stroke which the delivery is possible so as to adjust the number of times which the fuel is delivered to the common rail for each rotation of the engine in accordance with a load on the engine, thereby maintaining the fuel pressure in the common rail to a predetermined pressure level.

BRIEF DESCRIPTION OF THE DRAWINGS

FIG. 14 is a timing chart showing the operation of the high pressure supply pump in accordance with the sixth embodiment of the present invention.

DESCRIPTION OF THE PREFERRED EMBODIMENT

The embodiments of the present invention will be described below in conjunction with the accompanying drawings.

First Embodiment

Figure 1:
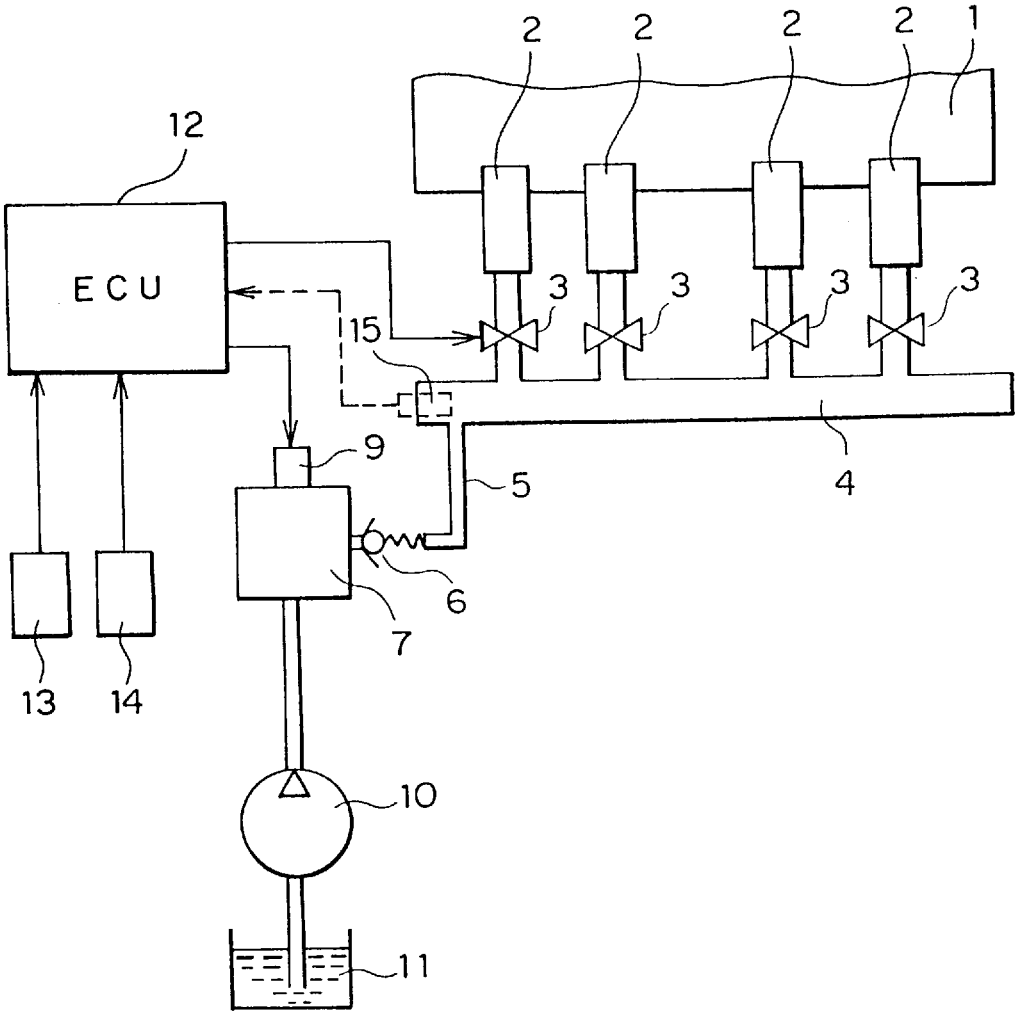
FIG. 1 is a schematic block diagram showing a fuel injector system in accordance with a first embodiment of the present invention.

FIG. 1 is a schematic block diagram showing a common rail type fuel injector system in accordance with a first embodiment of the present invention.

In the drawing, an engine 1 is a four-cylinder diesel engine of four strokes. The combustion chamber of each cylinder of the engine 1 has an injector 2 serving as an injection nozzle. An injection control solenoid valve 3 provided in each of the four injectors 2 is opened or closed to control the injection of fuel into the engine 1. A common rail 4 is a high pressure accumulator pipe common to all cylinders of the engine 1. The four injectors 2 are connected to the common rail 4, and the fuel in the common rail 4 is injected through the injectors 2 to the engine 1 when the injection control solenoid valves 3 are opened. The common rail 4 is connected to a check valve 6 provided on a high pressure supply pump 7 via a supply pipe 5. The high pressure supply pump 7 is driven by a cam driving mechanism 8 of the pump which will be described later in conjunction with FIG. 2 so as to deliver or forcibly feed the high pressure fuel to the common rail 4. The high pressure supply pump 7 is equipped with a spill control solenoid valve 9. The fuel is supplied to the high pressure supply pump 7 from a fuel tank 11 by a low pressure supply pump 10.

An electronic control unit 12 serving as the control means turns ON/OFF the injection control solenoid valves 3 and the spill control solenoid valve 9. The electronic control unit 12 receives the information on the speed and load of the engine 1 and the common rail pressure through an engine speed sensor 13, a load sensor 14, and a pressure sensor 15 which detects the common rail pressure. Specifically, in the common rail type fuel injector system, the information on the speed and load of the engine and the common rail pressure are supplied from the respective sensors 13, 14, and 15 to the electronic control unit 12 which controls a high pressure common rail system.

The electronic control unit 12 carries out negative feedback control of the common rail pressure while at the same time outputs a control signal to the injection control solenoid valves 3 so that the injection timing and the injection amount are adjusted to the optimum conditions which are determined according to the state of the engine 1 which is judged by signals indicative of the information mentioned above. The unit 12 also sends a control signal to the spill control solenoid valve 9, thereby adjusting the common rail pressure to an optimum injection pressure level.

For instance, a certain amount of fuel in the common rail 4 whose pressure has been accumulated to 100 MPa is consumed each time the injection control solenoid valves 3 is opened by a control pulse. To compensate for the consumed fuel, the high pressure supply pump 7 intermittently delivers the fuel to the common rail 4 by the amount required to compensate for the consumed amount in order to maintain the common rail pressure at the same 100 MPa level at all times. The required delivery amount varies depending on the injection amount or engine speed. Therefore, the amount of one delivery of the high pressure supply pump 7 is adjusted by controlling the operation of the spill control solenoid valve 9 by the electronic control unit 12. To perform the high pressure supply, maintenance, and control, the fuel is supplied in synchronization with a single operation cycle of the fuel injector system, that is, for every injection. Therefore, a jerk type pump, which intermittently reciprocates and which is capable of performing the same delivery cycles of fuel as the number of combustion cycles of the engine 1, is employed for the high pressure supply pump 7.

The high pressure supply pump 7 will now be described with reference to FIG. 2.

Figure 2:
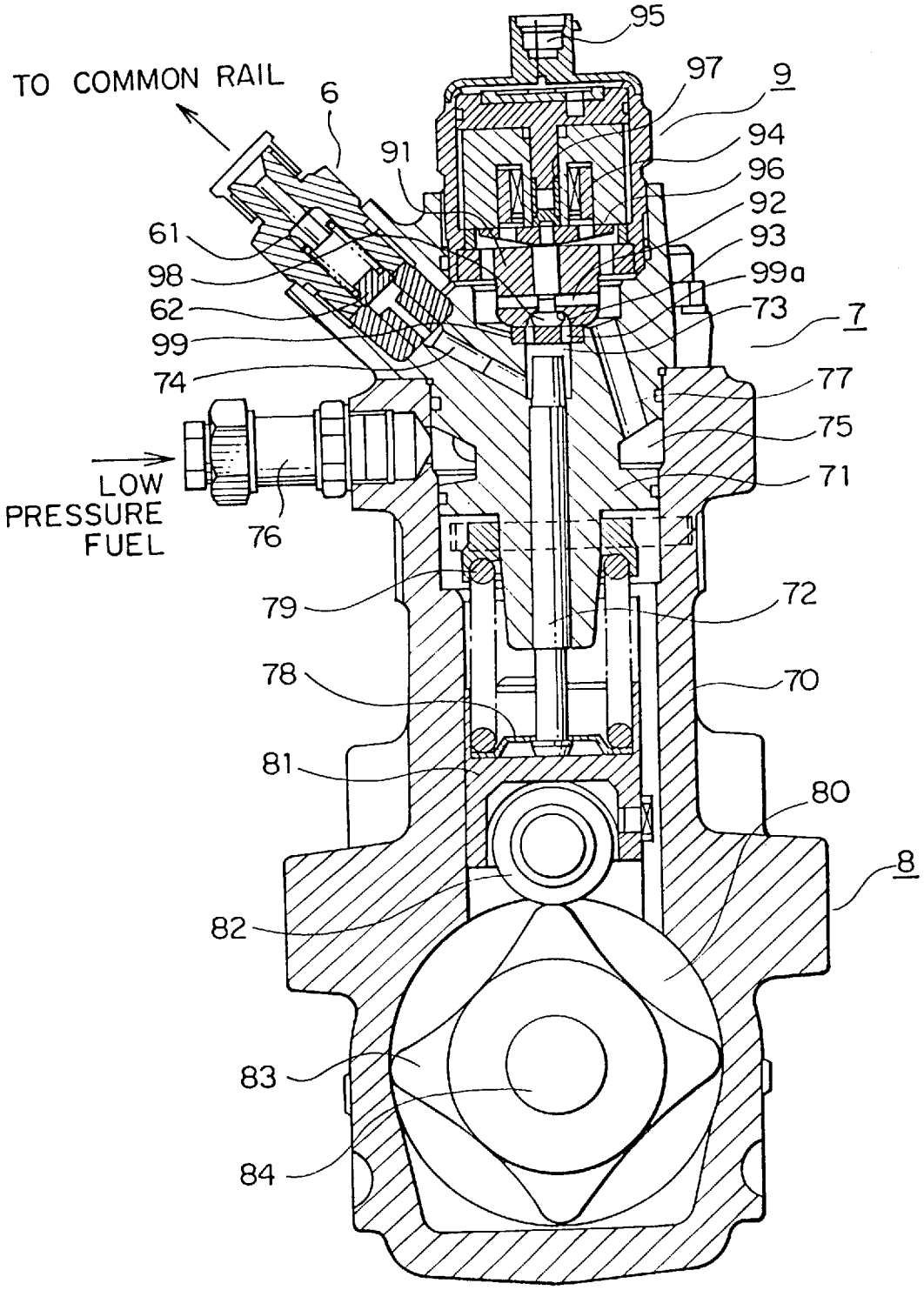
FIG. 2 is a sectional view showing a high pressure supply pump of the fuel injector system in accordance with the first embodiment of the present invention.

In FIG. 2, a cam chamber 80 of the pump driving mechanism 8 is provided at the bottom end of a pump housing 70 and a cylinder 71 is installed in the pump housing 70. A plunger 72 is installed in the cylinder 71 in such a manner that it can reciprocate and slide therein. The top end surface of the plunger 72 and the inner peripheral surface of the cylinder 71 constitute a pump chamber 73 which is communicated with the check valve 6 via a discharge port 74 serving as a communicating passage. The high pressure supply pump 7 is provided with a fuel reservoir 75 to which the low pressure fuel is supplied by the low pressure fuel pump 10 from the fuel tank 11 via an introduction pipe 76. The fuel reservoir 75 and the spill control solenoid valve 9 are communicated through a passage 77. A valve seat 78 connected at the bottom end of the plunger 72 is pressed against a cam follower 81 by a plunger spring 79 and a cam roller 82 is provided on the cam follower 81. A cam 83 is secured to a driving shaft 84 and is rotatably disposed in the cam chamber 80. The cam 83 is slidably in contact with the cam roller 82, the outer periphery thereof having a shape formed by four identical hills or carving projections. The driving shaft 84 of the cam 83 rotates at a half speed of the engine 1.

Hence, when the cam 83 is rotated by the rotary shaft 84 of the cam 83, the plunger 72 starts reciprocating motion via the cam roller 82, the cam follower 81, and the valve seat 78. The reciprocating stroke of the plunger 72 is determined by the difference in height between the top and bottom of the hills. As the plunger 72 reciprocates in the cylinder 71, the fuel on the low pressure side is taken into the pump chamber 73. The fuel which has been taken in is forcibly fed or delivered when the spill control solenoid valve 9, which will be discussed in detail later, is closed. When the solenoid valve is opened, some portion of the fuel is returned to the low pressure end.

The spill control solenoid valve 9 will now be described with reference to FIG. 2.

A body 91 has a passage 92 which is communicated with the passage 77 formed on the cylinder 71. A valve seat 93 is provided on the body 91 on the side closer to the pump chamber 73. An electromagnetic coil 94 which is energized via a lead wire 95 is provided on the top of the body 91. An armature 96 is drawn upward in FIG. 2 by the magnetic force of the energized electromagnetic coil 94 against the urging force of a spring 97. An outward opening valve 98 is connected to the armature 96 into one unit, and when the electromagnetic coil 94 is de-energized, the valve 98 is brought down to the bottom in FIG. 2 by the elastic force of the spring 97, causing the passage 92 to be communicated with the pump chamber 73. When the electromagnetic coil 94 is energized, the valve 98 is brought back in the valve seat 93 to shut off the passage between the passage 92 and the pump chamber 73. A stopper 99 is provided on the cylinder 71 to decide the bottom position of the outward opening valve 98. The stopper 99 comes in contact with the bottom end of the outward opening valve 98 to restrict the position of the outward opening valve 98 when the electromagnetic coil 94 is de-energized, and it is provided with a plurality of through holes 99*a* through which fuel can flow.

The spill control solenoid valve 9 is a pre-stroke control type solenoid valve for setting the timing at which the outward opening valve 98 is seated on the valve seat 93 to start the pressurization of the plunger 72.

The schematic configuration of the high pressure supply pump 7 and the pump driving mechanism 8 will now be described with reference to FIG. 3.

Figure 3:
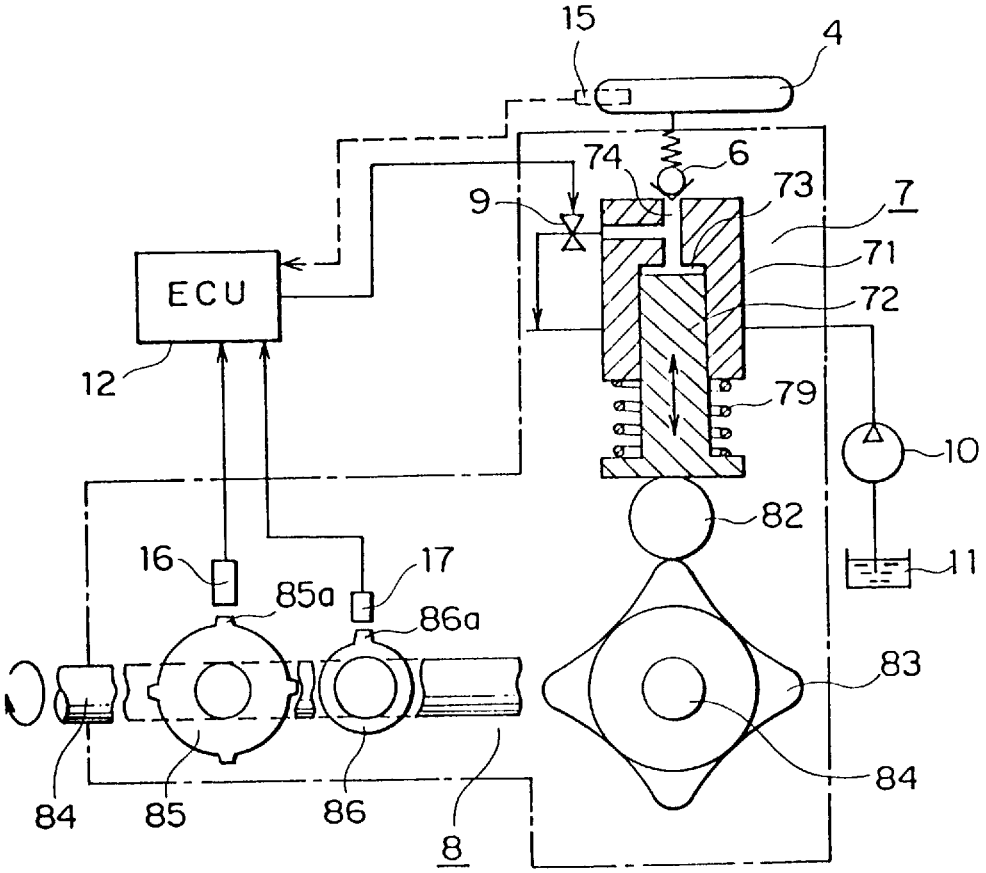
FIG. 3 is a schematic block diagram showing the high pressure supply pump and a pump driving mechanism of the fuel injector system in accordance with the first embodiment of the present invention.

In FIG. 3, a rotary disc 85 is coaxially attached to the driving shaft 84 of the cam 83. The rotary disc 85 has four projections 85*a* which respectively correspond to the engine cylinders. A cam angle sensor 16 which is an electromagnetic pickup is disposed facing against one of the projection 85*a*, so that every time one of the projection 85*a* passes near the cam angle sensor 16, a signal is sent to the electronic control unit 12. A cylinder identifying rotary disc 86 which has a single projection 86*a* is coaxially attached to the driving shaft 84 of the cam 83. A cylinder identifying sensor 17 is disposed facing against the projection 86*a*. Every time the projection 86*a* passes near the cylinder identifying sensor 17, that is, each time the high pressure supply pump 7 makes one reciprocating movement, one signal is sent to the electronic control unit 12. Based on the signals received from the cam angle sensor 16 and the cylinder identifying sensor 17, the electronic control unit 12 judges a bottom dead center of the plunger 72 of the high pressure supply pump 7.

In the configuration shown in FIG. 3, when the plunger 72, which is reciprocated by the rotation of the driving shaft 84, comes down, the spill control solenoid valve 9 is open and the fuel is introduced into the pump chamber 73 via the low pressure supply pump 10 and the spill control solenoid valve 9 from the fuel tank 11. When the plunger 72 goes up, it attempts to pressurize the fuel in the pump chamber 73. At this time, if the spill control solenoid valve 9 is not energized, then the outward opening valve 98 is apart from the valve seat 93 and the valve 9 is opened, and the fuel in the pump chamber 73 overflows via fuel passages 92, 77, the fuel reservoir 75, and the introduction pipe 76 in the order in which they are listed.

When a control pulse is sent to the spill control solenoid valve 9 to energize the spill control solenoid valve 9, the outward opening valve 98 is seated in the valve seat 93 and the valve 9 is closed. This causes the plunger 72 to pressurize the fuel in the pump chamber 73. As soon as the fuel pressure in the pump chamber 73 overcomes the urging force of the spring 61 disposed on the check valve 6, the fuel delivered via the discharge port 74 pushes a valve 62 open, so that the fuel is delivered into the common rail 4.

The operation of the fuel injector system in accordance with the first embodiment of the present invention will be described with reference to FIGS. 3 and 4.

Figures 4A, 4B, 4C, 4D:
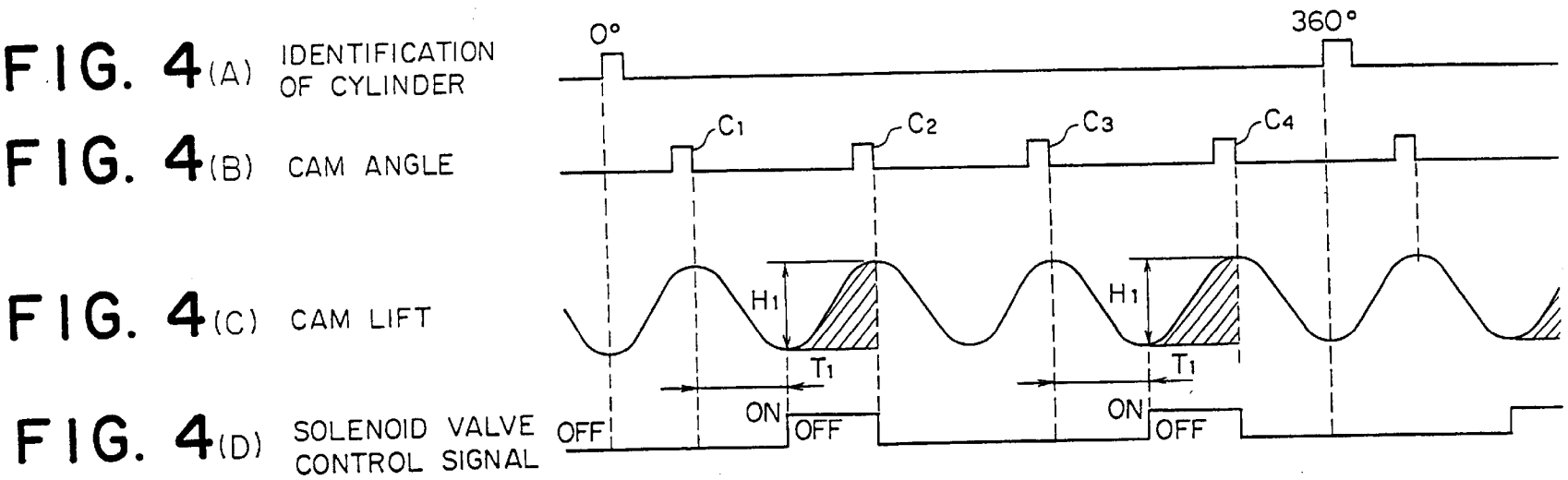
FIG. 4 is a timing chart showing the operation of the high pressure supply pump in accordance with the first embodiment of the present invention.

The timing chart of FIG. 4 is indicative of the operation of the high pressure supply pump 7 for the period of one rotation of the pump, i.e., for the period of 360-degree rotation of the cam.

In FIG. 4, (A) indicates the signal of the cylinder identifying sensor 17 and (B) indicates the signal of the cam angle sensor 16. Based on the signals received from the two sensors 16 and 17, the electronic control unit 12 determines and inputs a signal indicative of the bottom dead center of the plunger 72 of the high pressure supply pump 7. (C) indicates the lift amount of the cam 83 and (D) denotes the control signal of the spill control solenoid valve 9. In the high pressure supply pump 7, four delivery strokes which the fuel delivery is possible take place so as to respectively correspond to the engine cylinders while the driving shaft 84 makes one complete rotation.

When the cam 83 is rotated and when a time $T_1$ has passed from the trailing edge of a cam angle signal $C_1$, namely when the plunger 72 has arrived at the bottom dead center thereof, the electronic control unit 12 sends a control signal to the spill control solenoid valve 9, and the control signal is cut off at the trailing edge of the following cam angle signal $C_2$, namely when the plunger 72 has arrived at the top dead center thereof. While the control signal is being applied, the spill control solenoid valve 9 is held closed. Thus, the fuel in the pump chamber 73 which has been pressurized by the plunger 72 for a cam lift amount $H_1$ after the solenoid valve 9 was closed (indicated by the hatched sections in FIG. 4) flows into the common rail 4 via the check valve 6 and it is accumulated in the common rail 4.

Similarly, the control signal is sent to the spill control solenoid valve 9 from the electronic control unit 12 when the time $T_1$ has passed from the trailing edge of the cam angle signal $C_3$ and the control signal is cut off at the trailing edge of the following cam signal $C_4$.

Thus, in the first embodiment, two cycles of pumping or delivery are implemented during one rotation of the driving shaft 84 of the cam 83 and the spill control solenoid valve 9 is held closed during the full period of delivery strokes, in which the fuel delivery is possible, so as to pressurize the fuel in the pump chamber 73 and accumulate it in the common rail 4. The delivery stroke during which the fuel delivery is possible means the rising stroke of the plunger 72 moving from the bottom dead center to the top dead center of the plunger 72. This corresponds to the rising slope sections in the waveform (C) shown in FIG. 4.

Further, the delivery amount of the fuel required for generating or maintaining the common rail pressure can be controlled according to the load on the engine by adjusting the number (0~4) of the delivery strokes during one rotation of the driving shaft 84 of the cam 83 in accordance with the engine speed detected by the speed sensor 13, the engine load detected by the load sensor 14, or the common rail pressure detected by the pressure sensor 15, thereby permitting the desired common rail pressure to be reached.

Then, in the case that the electronic control unit 12 sends control signals to the spill control solenoid valve 9 when the time $T_1$ has passed from each trailing edges of cam angle signals $C_1$, $C_2$, $C_3$, and $C_4$, four cycles of pump delivery are implemented during one rotation of the driving shaft 84 of the cam 83, thereby increasing the delivery amount of fuel. On the other hand, in the case that electronic control unit 12 sends no control signals to the spill control solenoid valve 9 even if cam angle signals $C_1$, $C_2$, $C_3$, and $C_4$ are generated, the spill control solenoid valve 9 is not energized. Hence, the fuel in the pump chamber 73 is put back to the low pressure side, since it is not pressurized, no fuel will be delivered to the common rail 4.

According to the first embodiment, the electronic control unit 12 holds the spill control solenoid valve 9 closed (fully closed) or opened (fully open) throughout the full period of all four delivery strokes of the high pressure supply pump 7, during which the delivery is possible, in accordance with the engine speed detected by the speed sensor 13, the engine load detected by the load sensor 14, or the common rail pressure detected by the pressure sensor 15, thereby permitting the desired common rail pressure to be reached.

Therefore, complicated control is no longer necessary to control the opening and closing operation of the spill control solenoid valve 9, thus permitting extremely easy control thereof.

Second Embodiment

In the first embodiment described above, the high pressure supply pump 7, the cam 83, the cam roller 82, the spill control solenoid valve 9, etc. are provided one each. In this embodiment, however, these components are provided two each sharing the same capacities and shapes, namely, high pressure supply pumps 7 and 7A, cams 83 and 83A, cam rollers 82 and 82A, spill control solenoid valves 9 and 9A.

Figure 5:
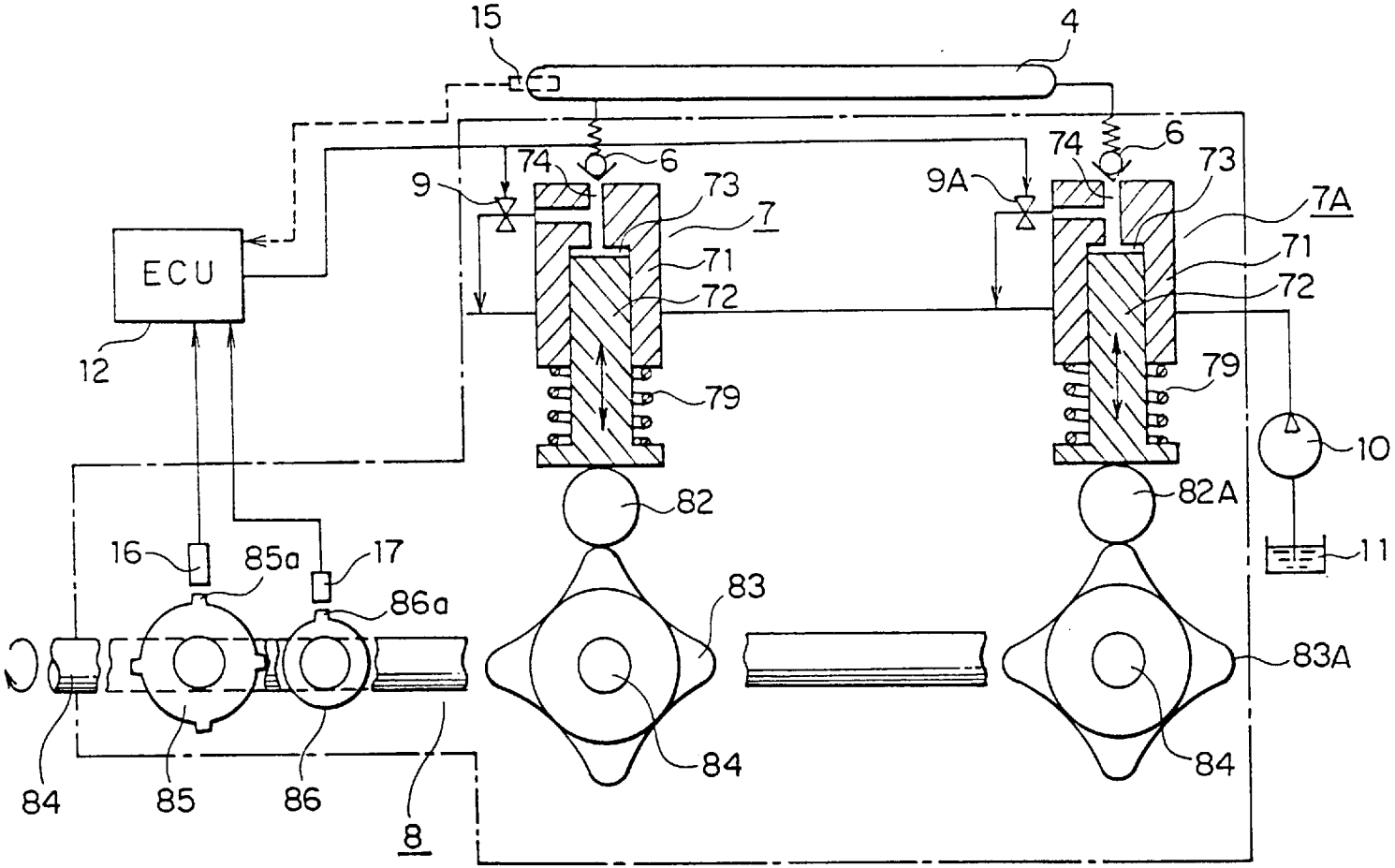
FIG. 5 is a schematic block diagram showing the high pressure supply pump and a pump driving mechanism of the fuel injector system in accordance with the second embodiment of the present invention.
Figure 6:
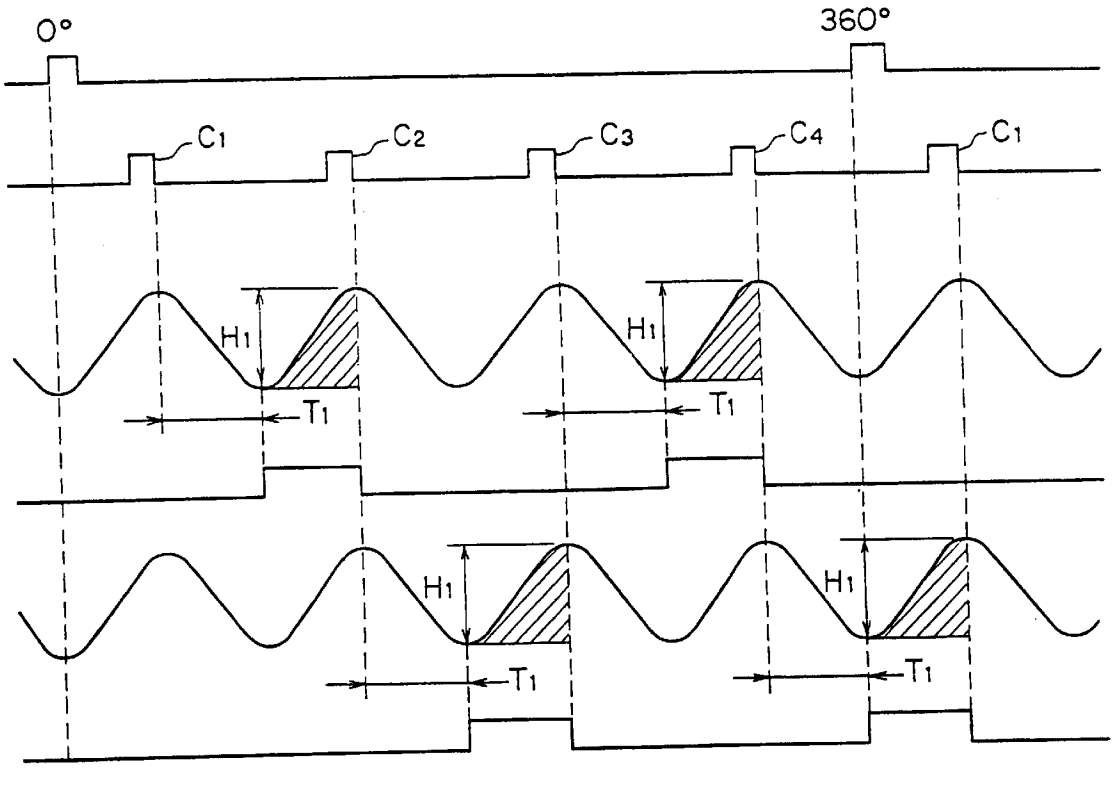
FIG. 6 is a timing chart showing the operation of the high pressure supply pump in accordance with the second embodiment of the present invention.

In the second embodiment, the two cams 83 and 83A are formed to have the same shape and lift amount and they are rotated in synchronization with each other as illustrated in FIGS. 5 and 6. Therefore, when the time $T_1$ has passed from the trailing edges of the cam angle signals $C_1$ and $C_3$, respectively, the electronic control unit 12 sends a control signal to the spill control solenoid valve 9. Thereby, the spill control solenoid valve 9 is closed. These control signals are respectively cut off at the trailing edges of the following cam angle signals $C_2$ and $C_4$. Thereby, the spill control solenoid valve 9 is opened.

When the time $T_1$ has passed from the trailing edges of the cam angle signals $C_2$ and $C_4$, respectively, the electronic control unit 12 sends a control signal to the spill control solenoid valve 9A. Thereby, the spill control solenoid valve 9A is closed. These control signals are respectively cut off at the trailing edges of the following cam angle signals $C_3$ and $C_1$. Thereby, the spill control solenoid valve 9A is opened.

According to the second embodiment, the spill control solenoid valves 9 and 9A are closed (fully closed) or opened (fully open) in accordance with the engine speed, the engine load, or the common rail pressure. Thereby, the delivery amount of the fuel required for generating or maintaining the desired common rail pressure can be controlled and the desired common rail pressure can be maintained.

Third embodiment

Figure 7:
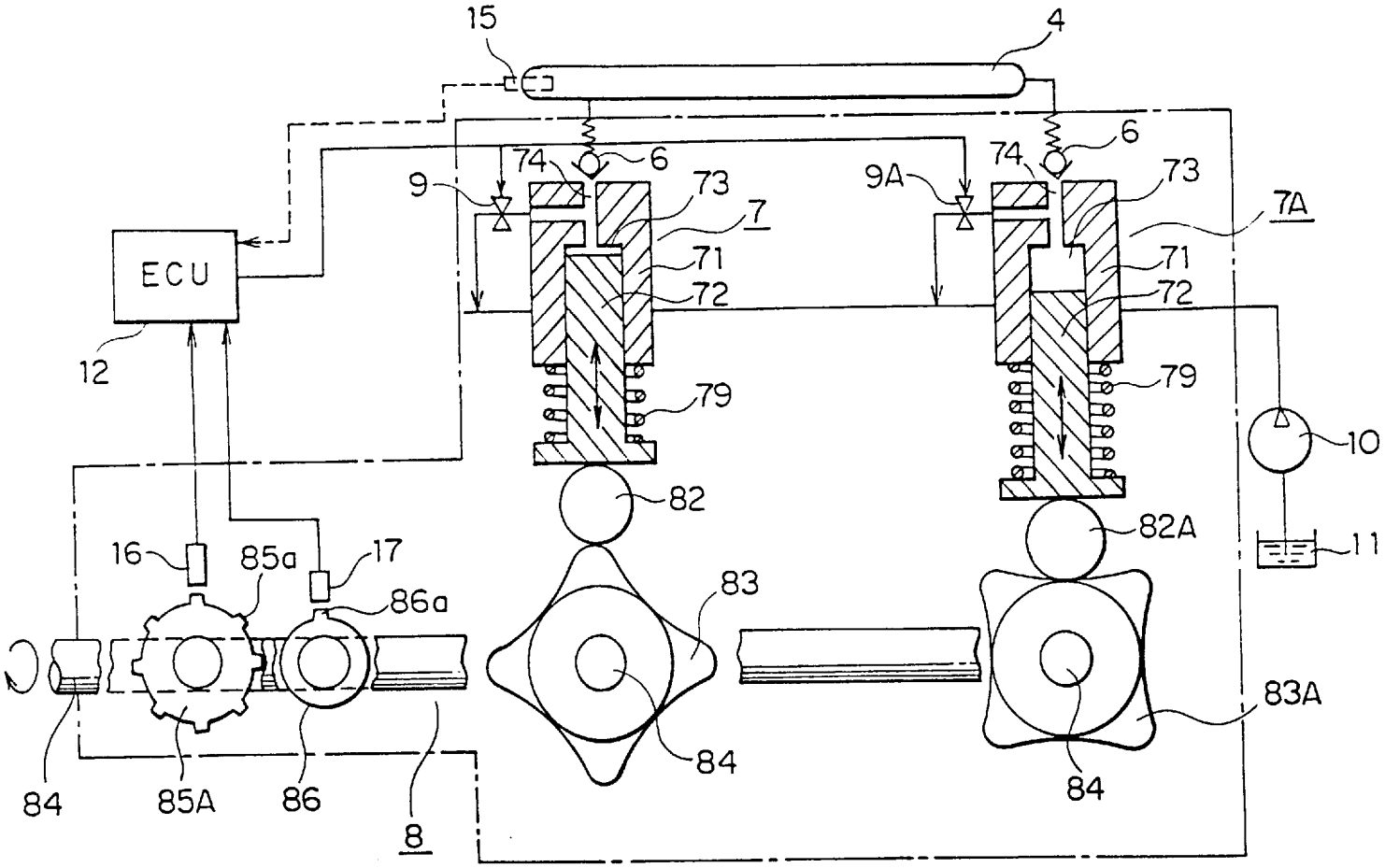
FIG. 7 is a schematic block diagram showing the high pressure supply pump and a pump driving mechanism of the fuel injector system in accordance with the third embodiment of the present invention.
Figure 8:
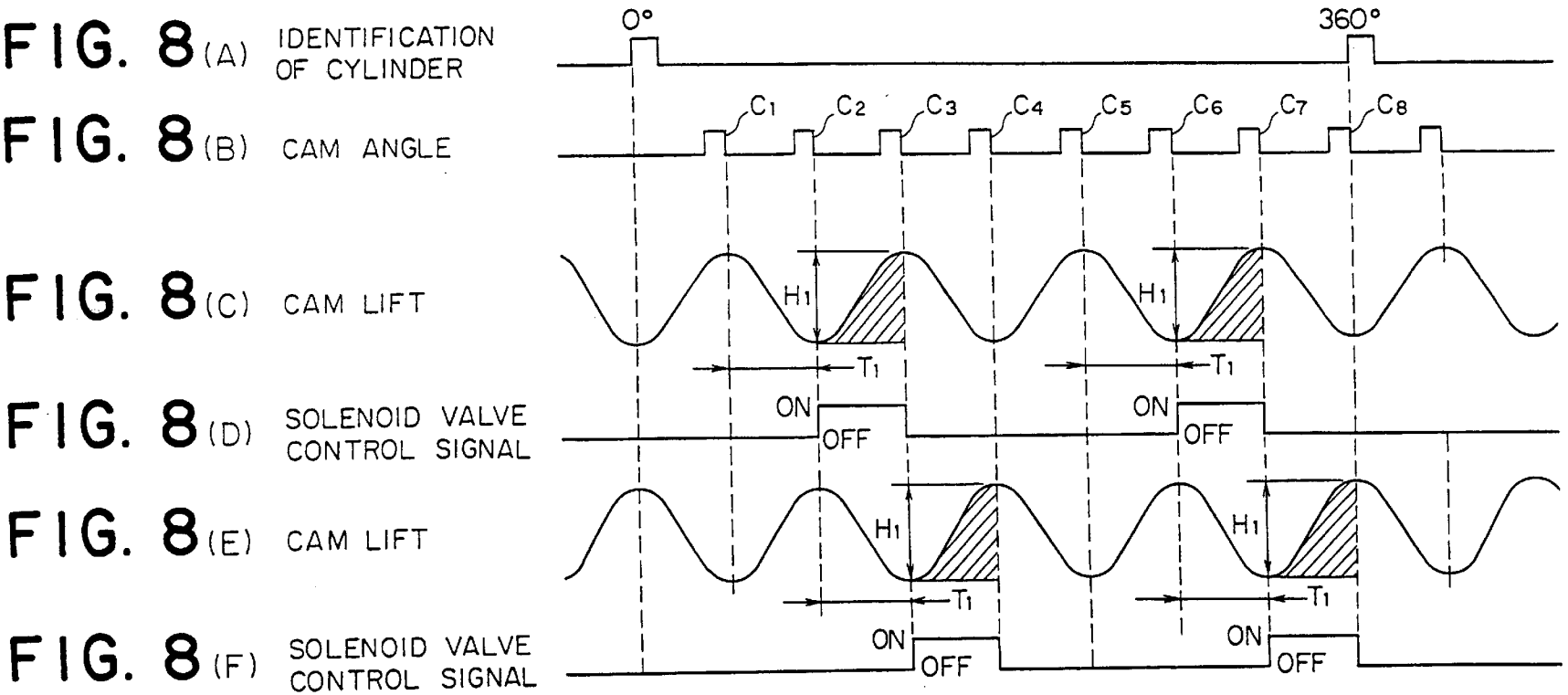
FIG. 8 is a timing chart showing the operation of the high pressure supply pump in accordance with the third embodiment of the present invention.

In the second embodiment described above, the change in the lift amount of the cams 83 is in synchronization with the change in the lift amount of the cam 83A, whereas in this embodiment, the change in the lift amount of the cams 83 is not in synchronization with the change in the lift amount of the cam 83A as illustrated in FIGS. 7 and 8.

Namely, in FIGS. 7 and 8, the two cams 83 and 83A are coaxially mounted on the rotary shaft 84, but shifted by 45 degrees in angle in the rotational direction thereof. These cams 83 and 83A respectively rotate in slidable contact with the cam rollers 82 and 82A. Further, a rotary disc 85A coaxially attached to the driving shaft 84 of the cams 83 and 83A has eight projections 85*a* which are formed on the outer periphery at equal angular intervals in the circumferential direction.

In the fuel injector system thus configured, eight cam angle signals $C_1$~$C_8$ are generated as illustrated in FIG. 8. When the time $T_1$ has passed from the trailing edges of the cam angle signals $C_1$ and $C_5$, respectively, (namely, at the trailing edges of the cam angle signals $C_2$ and $C_6$,) the electronic control unit 12 sends a control signal to the spill control solenoid valve 9. Thereby, the spill control solenoid valve 9 is closed. These control signals are respectively cut off at the trailing edges of the following cam angle signals $C_3$ and $C_7$. Thereby, the spill control solenoid valve 9 is opened.

On the other hand, when the time $T_1$ has passed from the trailing edges of the cam angle signals $C_2$ and $C_6$, respectively, (namely, at the trailing edges of the cam angle signals $C_3$ and $C_7$,) the electronic control unit 12 sends a control signal to the spill control solenoid valve 9A. Thereby, the spill control solenoid valve 9A is closed. These control signals are respectively cut off at the trailing edges of the following cam angle signals $C_4$ and $C_8$. Thereby, the spill control solenoid valve 9A is opened.

According to the third embodiment, the lift amounts of the cams 83 and 83A are shifted by 45 degrees in angle in the rotational direction from each other. Therefore, the fuel delivery timings at which the high pressure supply pumps 7 and 7A deliver the fuel into the common rail 4 are shifted by 45 degrees in angle in the rotational direction from each other. Namely, the fuel delivery timing of the high pressure supply pimp 7 for the common rail 4 is synchronized with the fuel injection timing of the injection control solenoid valve 3 for the respective cylinders of the engine 1. Further, the fuel delivery timing of the high pressure supply pimp 7A for the common rail 4 is not synchronized with the fuel injection timing of the injection control solenoid valve 3.

In the third embodiment, since the number of pump delivery strokes is selected among the eight pump delivery strokes according to the load on the engine 1, the amplitude of a pressure wave per one delivery becomes smaller. Further, owing to the intermittent pump delivery, the interval or cycle of the pressure waves is not constant.

Therefore, the fuel injector system of the third embodiment can restrain an enlargement of the fluctuations in the common rail pressure generated by overlapping the fluctuations in the common rail pressure caused by the fuel injection of the injection control solenoid valve 3 and the delivery pressure of the high pressure supply pumps 7 and 7A and a microseisums in the common rail pressure caused by a water hammer originated in the sudden closing of the injection control solenoid valve 3.

Fourth embodiment

Figure 9:
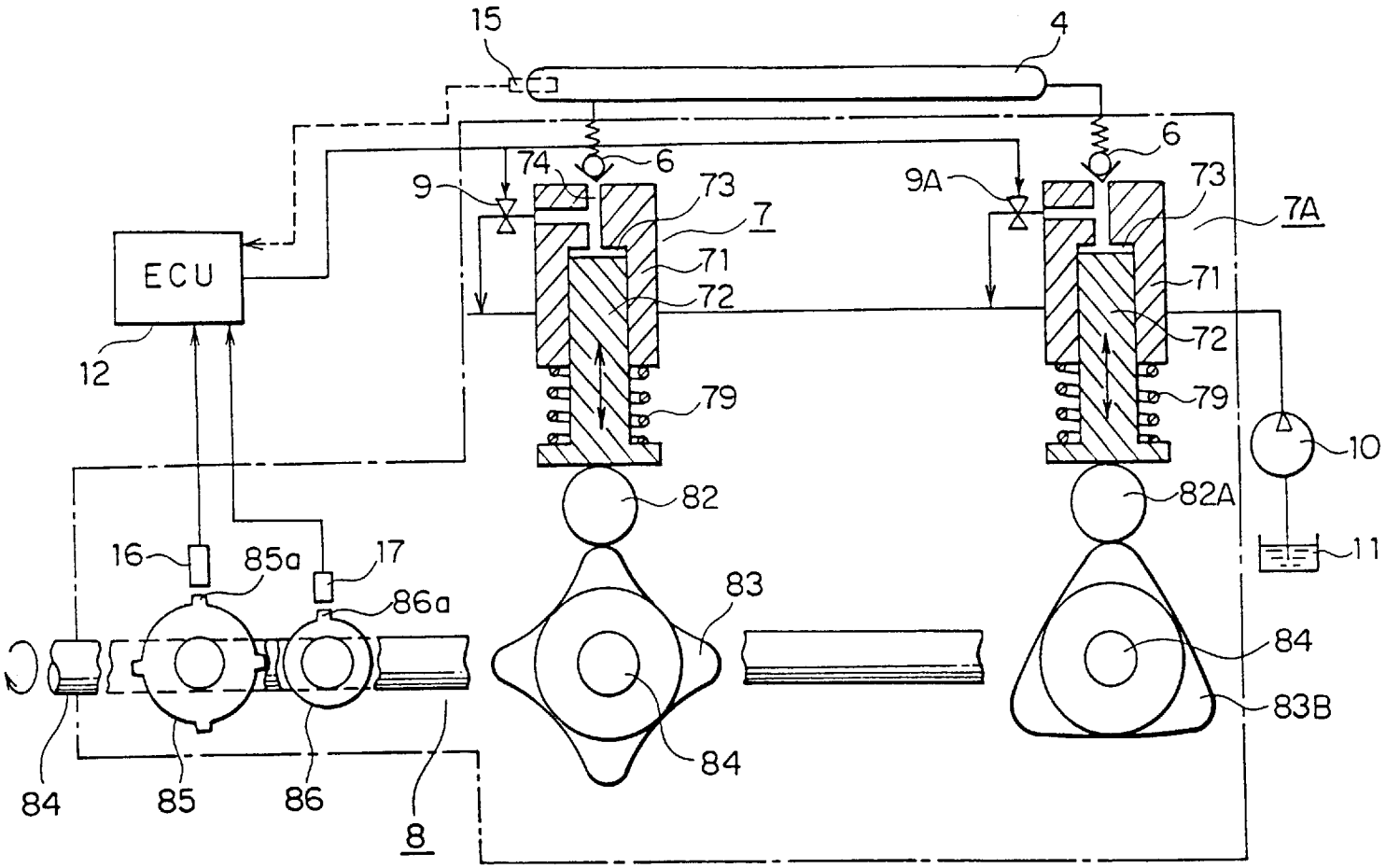
FIG. 9 is a schematic block diagram showing the high pressure supply pump and a pump driving mechanism of the fuel injector system in accordance with the fourth embodiment of the present invention.
Figure 10:
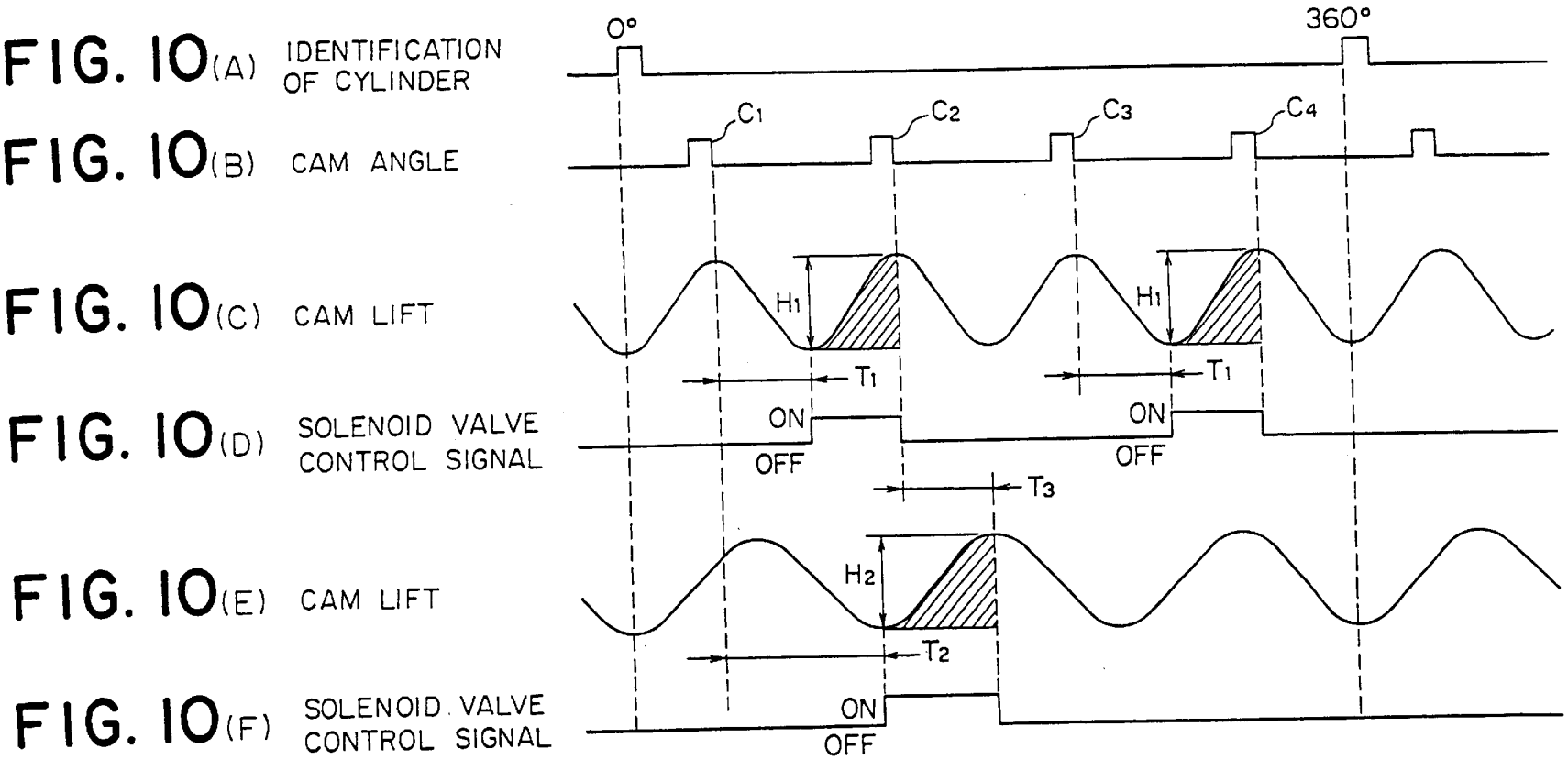
FIG. 10 is a timing chart showing the operation of the high pressure supply pump in accordance with the fourth embodiment of the present invention.

In the third embodiment described above, the two cams 83 and 83A are formed to have the same shape and are coaxially mounted on the rotary shaft 84, but shifted by 45 degrees in angle in the rotational direction thereof, whereas, in this embodiment shown in FIGS. 9 and 10, a cam 83B is mounted on the rotary shaft 84 instead of the cam 83A, the outer periphery thereof having a triangle shape formed by three identical hills as illustrated in FIG. 9. Then, the lift amount $H_2$ of the cam 83B is equal to the lift amount $H_1$ of the cam 83.

In the fuel injector system thus configured, four cam angle signals $C_1$~$C_4$ are generated as illustrated in FIG. 10. When the time $T_1$ has passed from the trailing edges of the cam angle signals $C_1$ and $C_3$, respectively, the electronic control unit 12 sends a control signal to the spill control solenoid valve 9. Thereby, the spill control solenoid valve 9 is closed. These control signals are respectively cut off at the trailing edges of the following cam angle signals $C_2$ and $C_4$. Thereby, the spill control solenoid valve 9 is opened.

On the other hand, when the time $T_2$ has passed from the trailing edge of the cam angle signal $C_1$, that is, when the plunger 72 of the pump 7A has arrived at the bottom dead center thereof, the electronic control unit 12 sends a control signal to the spill control solenoid valve 9A. Thereby, the spill control solenoid valve 9A is closed. When the time $T_3$ has passed from the trailing edge of the following cam angle signal $C_2$, that is, when the plunger 72 of the pump 7A has arrived at the top dead center thereof, the control signal is cut off. Thereby, the spill control solenoid valve 9A is opened.

According to the fourth embodiment, the lift amount changes of the cams 83 and 83B are not synchronized and are shifted each other. Further, the delivery amounts of the fuel indicated by the hatched sections in FIG. 10 differ each other.

Therefore, the fuel injector of the fourth embodiment can easily restrain the enlargement of the fluctuations in the common rail pressure generated by overlapping the fluctuations in the common rail pressure and the microseisums in the common rail pressure as compared with the third embodiment.

Fifth embodiment

This fifth embodiment will be described with reference to FIGS. 11 and 12.

Figure 11:
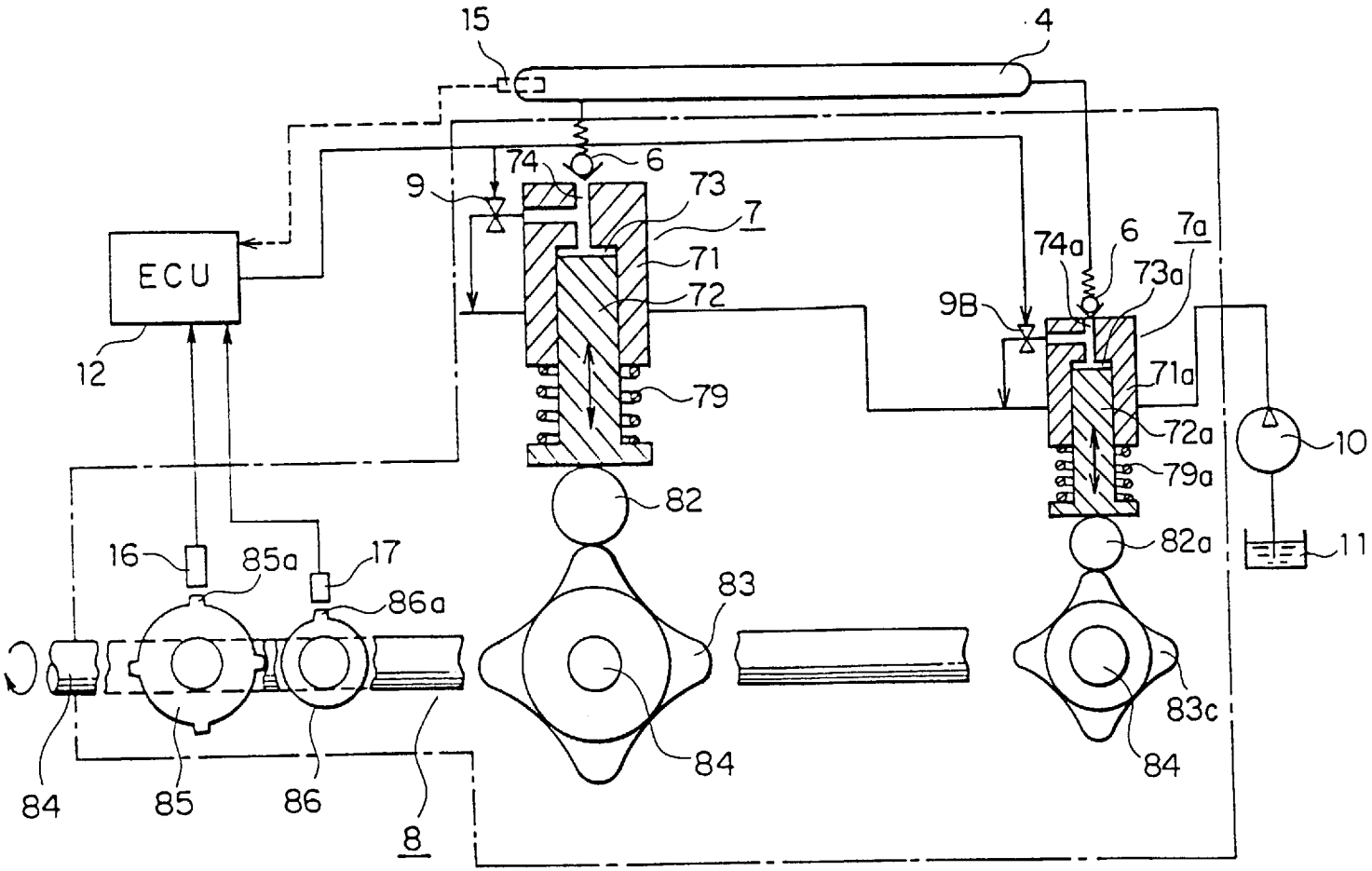
FIG. 11 is a schematic block diagram showing the high pressure supply pump and a pump driving mechanism of the fuel injector system in accordance with the fifth embodiment of the present invention.
Figure 12:
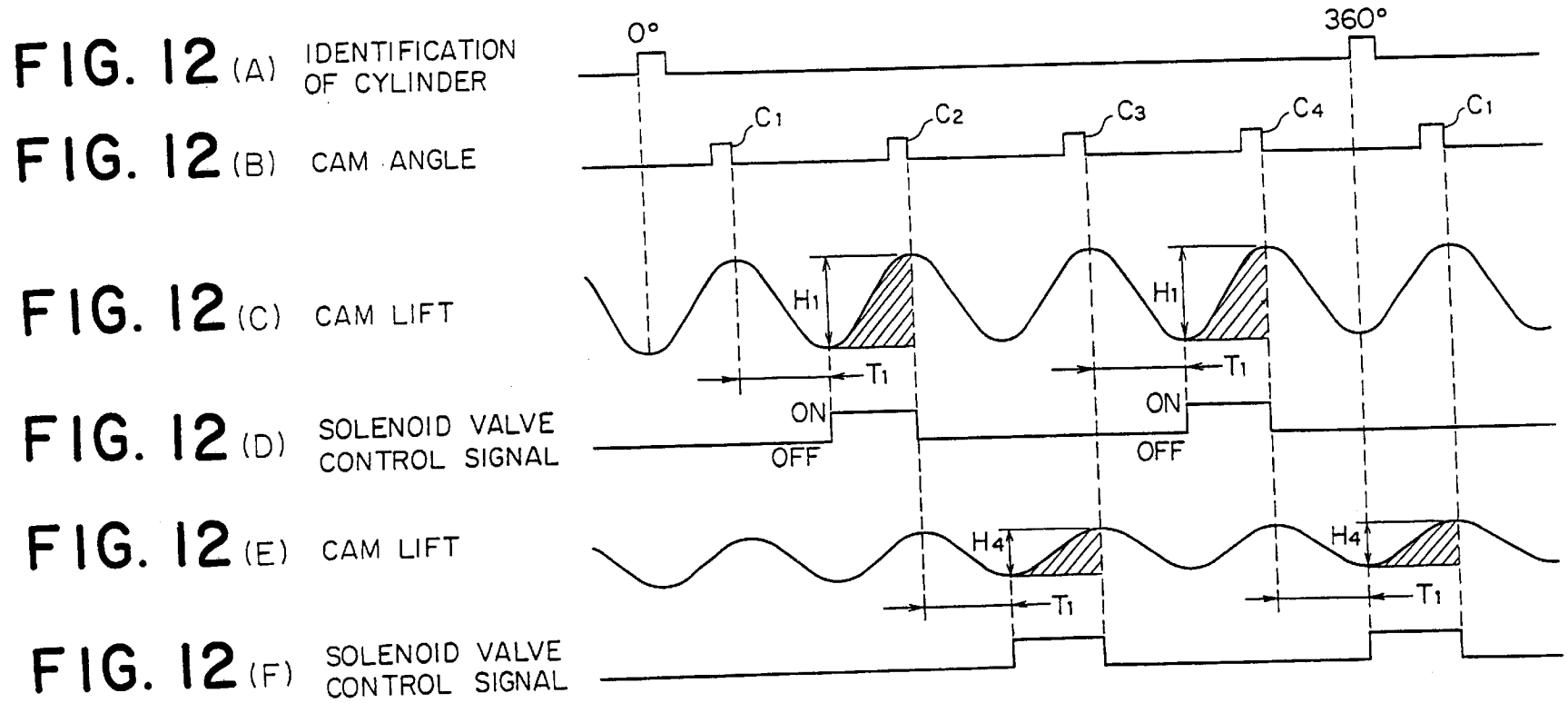
FIG. 12 is a timing chart showing the operation of the high pressure supply pump in accordance with the fifth embodiment of the present invention.

In FIGS. 11 and 12, the pump capacity of a high pressure supply pump 7*a* is smaller than that of the high pressure supply pump 7. A cylinder 71*a* is installed in the pump housing of the high pressure supply pump 7*a*. A plunger 72*a* is installed in the cylinder 71*a* in such a manner that it can reciprocate and slide therein. The top end surface of the plunger 72*a* and the inner peripheral surface of the cylinder 71*a* constitute a pump chamber 73*a* which is communicated with the check valve 6 via a discharge port 74*a* serving as a communicating passage. The plunger 72*a* is pressed against a cam roller 82*a* by a plunger spring 79*a*.

The outer periphery of a cam 83C has a shape formed by four identical hills. The cam 83C is mounted on the rotary shaft 84 in such a manner that hills of the cam 83C are synchronized with hills of the cam 83. Although not precisely illustrated, the maximal lift amount $H_4$ of the cams 83C is one half of the maximal lift amount $H_1$ of the cam 83.

In the fuel injector system thus configured, four cam angle signals $C_1$~$C_4$ are generated as illustrated in FIG. 12. When the time $T_1$ has passed from the trailing edges of the cam angle signals $C_1$ and $C_3$, respectively, the electronic control unit 12 sends a control signal to the spill control solenoid valve 9. Thereby, the spill control solenoid valve 9 is closed. These control signals are respectively cut off at the trailing edges of the following cam angle signals $C_2$ and $C_4$. Thereby, the spill control solenoid valve 9 is opened.

On the other hand, when the time $T_1$ has respectively passed from the trailing edges of the cam angle signals $C_2$ and $C_4$, namely, when the plunger 72*a* has arrived at the top dead center thereof, the electronic control unit 12 sends a control signal to the spill control solenoid valve 9B. Thereby, the spill control solenoid valve 9B is closed. These control signals are respectively cut off at the trailing edges of the following cam angle signals $C_3$ and $C_1$, namely, when the plunger 72*a* has arrived at the top dead center thereof. Thereby, the spill control solenoid valve 9B is opened.

According to the fifth embodiment, the lift changes of the cams 83 and 83C are synchronized and the pump delivery amount of the fuel of the high pressure supply pump 7 differs from the delivery amount of the fuel of the high pressure supply pump 7*a*. The electronic control unit 12 holds the spill control solenoid valves 9 and 9B closed or opened throughout the full period of all delivery strokes of the pumps 7 and 7*a*. Thus, the numbers of delivery strokes during which the spill control solenoid valves 9 and 9B are closed are controlled to adjust each of the delivery amounts of the pumps 7 and 7*a*, thereby adjusting the common rail pressure to a desired pressure. Further, the pump 7*a* is miniaturized and the torque required for driving the pump 7*a* is reduced, thereby minimizing the installation space thereof.

Sixth embodiment

Figure 13:
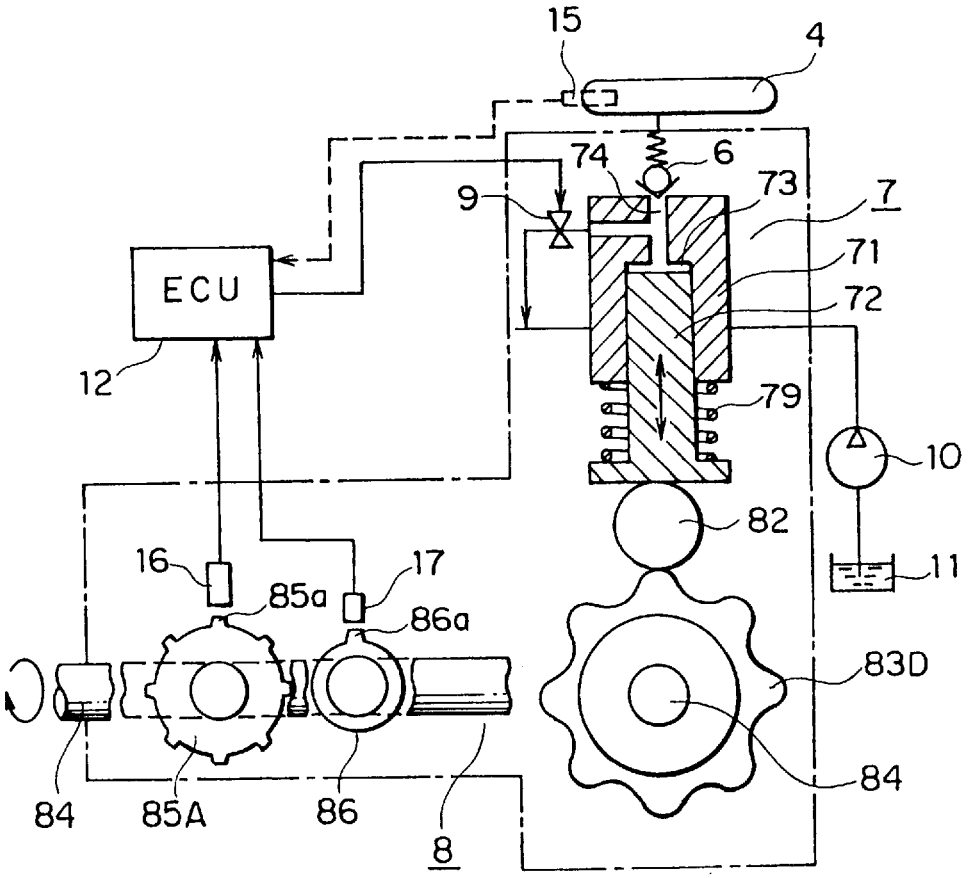
FIG. 13 is a schematic block diagram showing the high pressure supply pump and a pump driving mechanism of the fuel injector system in accordance with the sixth embodiment of the present invention.

This sixth embodiment will be described with reference to FIGS. 13 and 14.

The outer periphery of a cam 83D has a shape formed by eight identical hills. The cam 83D is mounted on the rotary shaft 84 and causes the plunger 72 of one high pressure supply pump 7 to make a reciprocating motion.

In the fuel injector system thus configured, eight cam angle signals $C_1$~$C_8$ are generated as illustrated in FIG. 14. When the time $T_1$ has respectively passed from the trailing edges of the cam angle signals $C_1$, $C_3$, $C_5$ and $C_7$, namely, when the plunger 72 has arrived at the bottom dead center thereof, the electronic control unit 12 sends a control signal to the spill control solenoid valve 9. Thereby, the spill control solenoid valve 9 is closed. These control signals are respectively cut off at the trailing edges of the following cam angle signals $C_2$, $C_4$, $C_6$ and $C_8$, namely, when the plunger 72 has arrived at the top dead center thereof. Thereby, the spill control solenoid valve 9 is opened.

According to the sixth embodiment, each time the rotary shaft 84 makes one turn, the fuel can be delivered from the high pressure supply pump 7 to the common rail 4 eight times at its maximum. The times of the fuel delivery can be controlled according to the engine speed, the engine load, or the common rail pressure. Therefore, the delivery amount of the fuel required for generating or maintaining the desired common rail pressure can be controlled by one high pressure supply pump 7. Further, it can minutely control the delivery amount of the fuel and can accurately control the common rail pressure to the desired pressure.

In the embodiments described above, the opening and closing operation of the spill control solenoid valve is controlled according to parameters of the engine including the engine speed, the engine load, the common rail pressure, etc. Especially, it controls the full opening period and the full closing period of the spill control solenoid valve, that is, the number of delivery cycles to bring the output signal of the pressure sensor 15 for detecting the pressure in the common rail 4 to a predeterminate value according to the engine speed and the engine load.

In the embodiments described above, the driving shaft 84 rotates at a half speed of that of the engine 1. The speed of the driving shaft 84, however, is not limited to the half speed of the engine 1. It is acceptable that the driving shaft rotates at a speed of one and half speed of the engine 1.

According to the present invention, there is provided a fuel injector system comprising a common rail for accumulating pressurized fuel; an injection nozzle for injecting the pressurized fuel in the common rail into an engine cylinder; a high pressure supply pump having a pump chamber into which the fuel flows, the high pressure supply pump delivering the fuel in the pump chamber into the common rail and pressurizing the fuel in the common rail; a spill solenoid valve which is provided in a path communicating the pump chamber with a low pressure fuel path and which, when opened, communicates the pump chamber with the low pressure fuel path and, when closed, delivers the fuel from the pump chamber to the common rail; and control means for controlling the opening and closing of the spill solenoid valve to keep the spill solenoid valve closed or opened for the entire period of time of each stroke which the delivery is possible so as to adjust the number of times which the fuel is delivered to the common rail for each rotation of the engine in accordance with a load on the engine, thereby maintaining the fuel pressure in the common rail to a predetermined pressure level. Therefore, the current control of the solenoid valve can be easily executed.

A plurality of the pump chambers and the spill solenoid valves are provided. Therefore, it can easily adjust the common rail pressure to a desired pressure level.

The pump chambers have same pump capacities each other, it can utilize same pump in each of the high pressure supply pumps, thereby easily performing the maintenance thereof.

At least one of the pump chambers have different pump capacities from others. Therefore, the desired common rail pressure can be optionally set by selecting the pump capacities.

Further, it has a plunger for pressurizing the fuel in the pump chamber and a cam for driving the plunger, while the cam is secured to a driving shaft driven by the engine and is provided with a plurality of rising slopes for driving the plunger so as to pressurize the fuel. Therefore, the number of the plungers can be reduced, permitting a more compact fuel injector system.

Further, it has a plunger for pressurizing the fuel in the pump chamber and a cam for driving the plunger, while a plurality of the cams is secured to the driving shaft driven by the engine. Therefore, the number of hills formed on the cam can be reduced, enhancing the productivity of the cam.

The driving shaft rotates at a half speed of that of the engine and each the cam has a shape formed four identical hills on an outer periphery thereof. Therefore, it can exactly deliver the fuel to the four-cylinder engine.

The plungers are respectively driven by the cams so as to pressurize the fuel at a same phase each other. Therefore, the current control of the spill solenoid valve can be easily executed.

The plungers are respectively driven by the cams so as to pressurize the fuel at different phases each other. Therefore, the enlargement of the fluctuations in the common rail pressure generated by overlapping the fluctuations in the common rail pressure caused by the fuel injection of the injection control solenoid valve and the delivery pressure of the high pressure supply pump and a pulsation in the common rail pressure caused by a water hammer originated in the sudden closing of the injection control solenoid valve can be restrained.

A rotary disc is secured to the driving shaft and having projections which respectively correspond to the engine cylinders and a electromagnetic pickup is disposed facing against the rotary disc, wherein the electromagnetic pickup outputs a cam angle signal at every time when one of the projections passes near thereof, the control means controls the opening and closing of the spill solenoid valve in accordance with the can angle signal. Therefore, the closing and opening of the spill solenoid valve can be exactly controlled.

Further, a cylinder identifying rotary disc is secured to the driving shaft and having one projection and a cylinder identifying electromagnetic pickup is disposed facing against the cylinder identifying rotary disc, wherein the cylinder identifying electromagnetic pickup outputs a signal at every time when the projection passes near thereof, the control means distinguishes a cylinder which injects the fuel on the basis of the signal and controls the opening and closing of a injection control solenoid valve corresponding to the cylinder which injects the fuel in serial order. Therefore, it can simplify the constitution for controlling the injection control solenoid valve.

Furthermore, a pressure sensor for detecting a common rail pressure is provided, wherein control means controls the opening and closing of the spill solenoid valve in accordance with an engine speed and an engine load so as to bring the common rail pressure detected by the pressure sensor to the predetermined pressure level. Therefore, the common rail pressure can be exactly adjusted to the desired pressure level.

What is claimed is:

1. A fuel injector system comprising:

a common rail for accumulating pressurized fuel;

an injection nozzle for injecting the pressurized fuel in said common rail into an engine cylinder of an engine;

a high pressure supply pump having a pump chamber into which said fuel flows, said high pressure supply pump delivering said fuel in said pump chamber into said common rail and pressurizing said fuel in said common rail;

a spill solenoid valve which is provided in a path communicating said pump chamber with a low pressure fuel path and which, when opened, communicates said pump chamber with said low pressure fuel path and, when closed, delivers said fuel from said pump chamber to said common rail; and control means for controlling the opening and closing of said spill solenoid valve to keep said spill solenoid valve closed or opened for the entire period of time of each stroke in which the delivery of fuel is possible so as to adjust the number of times which said fuel is delivered to said common rail for each rotation of said engine in accordance with a load on said engine, thereby maintaining the fuel pressure in said common rail at a predetermined pressure.

2. A fuel injector system according to claim 1, wherein said high pressure supply pump comprises a plurality of said pump chambers and said spill solenoid valves.

3. A fuel injector system according to claim 2, wherein said pump chambers have equal pump capacities with respect to each other.

4. A fuel injector system according to claim 2, wherein at least one of said pump chambers has a different pump capacity from the other pump chambers.

5. A fuel injector system according to claim 1, further comprising a plunger for pressurizing said fuel in said pump chamber and a cam for driving said plunger.

6. A fuel injector system according to claim 5, wherein said cam is secured to a driving shaft driven by said engine and is provided with a plurality of rising slopes for driving said plunger so as to pressurize said fuel.

7. A fuel injector system according to claim 6, wherein said driving shaft rotates at half the speed of said engine, and said cam has a shape comprising four identical hills on an outer periphery thereof.

8. A fuel injector system according to claim 2, further comprising a plurality of plungers for respectively pressurizing said fuel in said pump chambers and a plurality of cams for respectively driving said plungers.

9. A fuel injector system according to claim 8, wherein each of said cams is secured to a driving shaft driven by said engine and is provided with a plurality of rising slopes for driving said plunger so as to pressurize said fuel.

10. A fuel injector system according to claim 9, wherein said driving shaft rotates at the half speed of said engine, and each of said cams has a shape comprising four identical hills on an outer periphery thereof.

11. A fuel injector system according to claim 10, wherein said plungers are respectively driven by said cams so as to pressurize said fuel at a same phase with respect to each other.

12. A fuel injector according to claim 10, wherein said plungers are respectively driven by said cams so as to pressurize said fuel at different phases with respect to each other.

13. A fuel injector system according to claim 5, further comprising a rotary disc, secured to said driving shaft, having projections which respectively correspond to said engine cylinders, and an electromagnetic pickup disposed facing against said rotary disc, wherein said electromagnetic pickup outputs a cam angle signal every time one of said projections passes said electromagnetic pickup, wherein said control means controls the opening and closing of said spill solenoid valve in accordance with said cam angle signal.

14. A fuel injector system according to claim 13, further comprising a cylinder identifying rotary disc, secured to said driving shaft, having one projection, and a cylinder identifying electromagnetic pickup disposed facing against said cylinder identifying rotary disc, wherein said cylinder identifying electromagnetic pickup outputs a signal every time said projection passes said cylinder identifying electromagnetic pickup, wherein said control means distinguishes a cylinder which injects said fuel on the basis of said signal and controls the opening and closing of an injection control solenoid valve corresponding to said cylinder which injects fuel in serial order.

15. A fuel injector system according to claim 13, further comprising a pressure sensor for detecting a common rail pressure, wherein said control means controls the opening and closing of said spill solenoid valve in accordance with an engine speed and an engine load so as to bring said common rail pressure detected by said pressure sensor to said predetermined pressure level.

16. A fuel injector system comprising:

a common rail for accumulating pressurized fuel;

at least two injection nozzles for injecting the pressurized fuel in said common rail into respective engine cylinders of an engine;

at least two high pressure supply pumps each having a pump chamber into which said fuel flows, said high pressure supply pumps respectively delivering said fuel in said pump chambers into said common rail and pressurizing said fuel in said common rail;

at least two spill solenoid valves which are provided in a path respectively communicating said pump chambers with a low pressure fuel path and which, when opened, communicate said pump chambers with said low pressure fuel path and, when closed, deliver said fuel from said pump chambers to said common rail;

at least two plungers for respectively pressurizing said fuel in said pump chambers;

at least two cams for driving said plungers, respectively, wherein said cams have different shapes with respect to each other; and control means for controlling the opening and closing of said spill solenoid valves to keep said spill solenoid valves closed or opened for the entire period of time of each stroke in which the delivery of fuel is possible so as to adjust the number of times said fuel is delivered to said common rail for each rotation of said engine in accordance with a load on said engine, thereby maintaining the fuel pressure in said common rail at a predetermined pressure.

17. A fuel injector system comprising:

a common rail for accumulating pressurized fuel;

at least two injection nozzles for injecting the pressurized fuel in said common rail into respective engine cylinders of an engine;

at least two high pressure supply pumps each having a pump chamber into which said fuel flows, said high pressure supply pumps respectively delivering said fuel in said pump chambers into said common rail and pressurizing said fuel in said common rail;

at least two spill solenoid valves which are provided in a path respectively communicating said pump chambers with a low pressure fuel path and which, when opened, communicate said pump chambers with said low pressure fuel path and, when closed, deliver said fuel from said pump chambers to said common rail;

at least two plungers for respectively pressurizing said fuel in said pump chambers;

at least two cams for driving said plungers, respectively, wherein said cams are different in size relative to each other; and control means for controlling the opening and closing of said spill solenoid valves to keep said spill solenoid valves closed or opened for the entire period of time of each stroke in which the delivery of fuel is possible so as to adjust the number of times said fuel is delivered to said common rail for each rotation of said engine in accordance with a load on said engine, thereby maintaining the fuel pressure in said common rail at a predetermined pressure.

* * * * *